United States Patent [19]

Lauchenauer

[11] Patent Number: 4,606,944

[45] Date of Patent: Aug. 19, 1986

[54] DEWATERING PROCESS, PROCEDURE AND DEVICE

[75] Inventor: Alfred E. Lauchenauer, Horn, Switzerland

[73] Assignee: Adnovum AG, Switzerland

[21] Appl. No.: 629,725

[22] PCT Filed: Nov. 5, 1983

[86] PCT No.: PCT/EP83/00292

§ 371 Date: Jul. 9, 1984

§ 102(e) Date: Jul. 9, 1984

[87] PCT Pub. No.: WO84/01970

PCT Pub. Date: May 24, 1984

[30] Foreign Application Priority Data

Nov. 12, 1982 [GB] United Kingdom ..... 8232393
Dec. 10, 1982 [GB] United Kingdom ..... 8235346
Aug. 17, 1983 [GB] United Kingdom ..... 8322168

[51] Int. Cl.[4] ..... B05D 3/12

[52] U.S. Cl. ..... 427/296; 427/350; 427/369

[58] Field of Search ..... 162/101; 427/296, 350, 427/373, 369

[56] References Cited

U.S. PATENT DOCUMENTS 4,062,721 12/1977 Guyer et al. ..... 162/101
4,118,526 10/1978 Gregorian et al. ..... 427/350
4,365,968 12/1982 Gregorian et al. ..... 427/350 X

*Primary Examiner*—Michael R. Lusignan
*Attorney, Agent, or Firm*—Ostrolenk, Faber, Gerb & Soffen

[57] ABSTRACT

Use of an application of foam to air permeable sheet material by a variety of mechanical or pressure applied means in order to cause or allow the foam to enter the interstices of the material. The foam contains as an essential integer an agent capable of lowering the surface tension of the foaming liquid thereby effecting a dewatering/drying action on the material greater than that than would otherwise be applied.

33 Claims, No Drawings

DEWATERING PROCESS, PROCEDURE AND DEVICE

DESCRIPTION

This invention relates to a foam treatment process for sheet materials and has particular reference to a process for reducing the water content of such sheet material.

Ways to reduce the water content of sheet material such as textile sheet material, are well known. The most widely used and oldest known method involves squeezing the sheet material between a pair or several pairs of mangle rollers. While certain constructions of mangles enable the water content to be reduced to low levels (e.g. 40 to 60% depending on the material to be treated), mangle-type equipment has several disadvantages. The higher the nip pressure the better are the mangling effects, but, of course, the deformation of the substrate by the nip pressure becomes more pronounced.

Another drawback of the mangle principle is the lack of a simple, easily predictable correlation between nip pressure and the extraction effect. Using water content measuring instrument feedback to control and predetermine water retention levels is thus very difficult.

Another method frequently used is the vacuum extraction of water from textile sheet material. While it is possible to remove a certain amount of the water present in the interstices of the material, the friction between the vacuum slot and the moving sheet presents problems, particularly at high speeds, since adequate sealing become very difficult. Energy input thus may be too high in relation to the effects obtained (this is particularly true for all high speed operations).

Another method recommended for the removal of water from air permeable substrates is the blowing of air at very high air speeds against the surface of the moving sheet, usually at an angle of about 90° to the plane of the sheet. Energy input again is very substantial, and results vary greatly with the construction of the substrate (tightly woven/open weaves/nonwovens, etc.) while support of the sheet at a low level of friction may present serious problems, particularly in the case of webs having a low cohesive strength.

All these known treatments which precede the final drying step are aimed at reducing the level of residual water prior to drying to lower the energy input required to remove the water still present at a given dryer speed, and/or to increase the speed of the dryer and/or lower the drying temperature.

U.S. Pat. No. 4,062,721 describes and claims a method for removing water from a wet fibrous sheet comprising the steps of mixing an aqueous slurry comprising mineral and binder, depositing said aqueous slurry on a wire mesh to form a wet sheet, adding a surfactant foaming agent to the slurry, said step of adding said surfactant foaming agent being performed at substantially the time that said slurry is deposited on said wire mesh whereby essentially no internal foam is present in said wet sheet at the time of depositing, draining water from said wet sheet through said wire mesh, said drainage being aided by the force of gravity and draining additional water from said wet sheet through said wire mesh, said additional drainage being aided by air pressure differential created across the wet sheet whereby foam is generated within the wet sheet due to the passage of air therethrough.

This specification is concerned the production of fire retardant felted mineral fibre panels and it is a feature of the invention that the generation of a foam should be confined to within the felted material itself. U.S. Pat. No. 4,062,721 teaches with considerable emphasis, the importance of avoiding substantial foaming until the wet sheet is juxtaposed the air pressure differential created across the sheet.

We have found that if an air permeable sheet material is treated with a foam containing an agent capable of reducing the surface tension of the foamed liquid, then improved permeation by the air/liquifying of the air permeable sheet material, can be effected.

According to the present invention, therefore, there is provided a process for treating an air permeable sheet material for which process comprises:

applying foam containing an agent capable of lowering the surface tension of said foam liquid;

causing the foam to permeate the interstices of the sheet material by the application of a pressure gradient thereacross;

removing the foam from the other side of said sheet material.

The process of the invention may be used to dewater an air permeable sheet material, or to apply treatment materials thereto.

One aspect of the present invention, therefore, provides a deliquifying process for an air permeable sheet maerial which process comprises forming a foam containing agent capable of lowering the surface of said foam liquid, applying said foam to one side of an air permeable sheet material, causing the foam to permeate the interstices of the sheet material by the application of a pressure gradient and removing liquid and foam from the other side of said sheet material whereby the foam causes the liquid to be removed substantially from between the interstices of the sheet material.

An alternative aspect of the present invention provides a process for applying a reagent to an air permeable sheet material which process comprises:

forming a foam containing said reagent, applying said foam to one side of an air permeable sheet material, applying a pressure gradient across said sheet material to cause the foam to permeate the interstices of the sheet material, and removing foam from the other side of the sheet material.

In one embodiment of the present invention, there is provided a process for reducing the water content of air-permeable sheet material including the steps of:

1. applying a foam to wet air-permeable sheet material immediately prior to the drying step, the foam containing an agent capable of reducing the surface tension of water 2. causing the foam to permeate the structure and interstices of the air-permeable sheet material; by applying mechanical means such as mechanical pressure in the nip of at least two rollers and/or a pressure gradient between one face of the sheet material and the other, all of these steps or any one of them being repeated if desired.

The residual water may be removed even more effectively by carrying out steps 1. and 2. of the sequence described above, then blowing heated air of such volume and speed against one face of the wet air-permeable sheet material that the stream of heated air penetrates to a substantial degree through the sheet matrial, i.e. exits thereform on the opposing face at a speed and in a volume per minute which is at least 10% of the speed and volume blown against the other face.

The process of the invention is also extremely suitable for the lowering of the water content of wet double layers of sheet material, e.g. of two layers of textile fabrics.

This is particularly important because with a multiple layer processing e.g. of textile fabrics the process of the present invention provides at many finishing stages a very substantial saving in processing costs. The problems inherent in conventional methods for the water level reduction prior to drying become more severe in the case multi-layer handling since, for example, the nip action of rollers becomes less efficient and more complex, linear pressure in the nip due to the compressibility of two superimposed more or less open structures is smaller), and new problems arise, e.g. the formation of undesirable patterns (moire effects) and fibre entanglement between the two layers if the nip pressures are as high as they have to be to at least come near the effects obtainable with single layer processing. These advantages of the system become, of course, even more important if multilayer sheet material such as 10 to 20 layers of e.g. gauze fabrics, or multiple layers of sheet material with low physical integrity (such as non-wovens or paper) have to be processed.

The foam may be caused to permeate the interstices of the sheet material and may subsequently be removed therefrom by virtue of a pressure gradient applied across the material.

In a particular embodiment of the present invention, a vacuum may be applied to one side of the sheet material which serves to "pull" the foam through the air permeable sheet material to be treated.

The invention further includes, therefore, a process which comprises the following steps:

1. Applying a foam to one side of the air permeable sheet material to be treated said foam containing an agent capable of reducing the surface tension of the liquid.

2. Causing the foam to permeate the structure and interstices of the air permeable sheet material by causing a pressure gradient to form between the two surfaces of the air permeable sheet material, whereby the pressure on the side to which the foam was applied is higher, to cause the foam to permeate said air permeable sheet material, providing a foam flow-constraining and equalizing substrate having in wet state a lower air permeability than the wet air permeable sheet material, in intimate contact with the surface of the air permeable sheet material not coated with foam, wherein the pressure gradient is of a magnitude sufficient to cause the foam to pass through both the air permeable sheet material and through the foam flow constraining substrate.

The air permeable sheet materials which may be treated according to the present invention comprises woven, knitted and non-woven textile sheet material, paper at different levels of sheet formation (dewatering after the wet sheet has been formed, after dewatering treatments of other kinds), sheets of loose fibres (fibre stock in the form of webs, oriented or non-oriented sheets of loose fibres, i.e. in a layer having a thickness which is much smaller than the width, while the length is very large compared to the width, such as roving, sliver, webs produced by carding etc.). Textile fabrics may be present in single or multilayer configuration. As many as 16 layers have successfully been treated by the process of the present invention. Other airpermeable sheet material which may be dewatered by the process described may comprise a bed or layer of particulate matter, which is carried for instance on a porous conveyor belt (the foam flow-constraining substrate may serve as such, or it may travel on a porous endless belt).

In another typical embodiment, the air permeable sheet material may be quite thick, for example, a pulp sheet; initially such a layer may not be air permeable per se due to the amount of liquid present: on application of the pressure gradient, surplus water is removed and the sheet material becomes air permeable. Thus, the air permeable sheet materials of the invention include inherently air permeable sheet materials capable of becoming air permeable on application of the pressure gradient.

The airpermeable sheet material may be thin, i.e. have a low thickness, or be three-dimensional in the sense that it consists or more than one layer of a thinner material as for example a gauze.

The airpermeable sheet material may be structured, i.e. it may consist of or contain structural elements such as fibres or particles, clusters of fibres or particles with open spaces or voids between these elements, hereinafter referred to as "interstices". These structural elements may be bonded together by bonding agents, by hydrogen or other non-covalent bonds, by covalent bonds, by mechanical interlacing or entanglement, or they may not necessarily be held together, particularly in the case of sheets or layers of particulate matter.

The air permeable sheet material may comprise natural material and/or synthetic polymers. The sheet material may typically be less than 30 mm thick in the wet state, but thicker sheets may be treated if the airpermeability is sufficient to allow the foam to permeate the structure at a reasonable rate and under the influence of the available pressure gradient. The foam applied to the airpermeable sheet material is preferably aqueous, but it may contain if desired non-aqueous liquids, e.g. in the form of an emulsion. The foam contains an agent capable of reducing the surface tension of the foam liquid and in the case of said liquid being water, said agent may be cationic, anionic, non-ionic, amphoteric surfactants (tensides), or simply a non-surfactant lowering the surface tension of water when added thereto, e.g. alcohols (mono or polyhydroxy compounds), amines and amides. In certain cases it is desirable to remove such agents after dewatering, e.g. during drying. A volatile agent may be used, i.e. an agent lowering the surface tension of water which has a boiling point lower or close to the boiling point of water, which is carried off by water vapour; alternatively an agent may be used which decomposes at temperatures in the range of 50° to 100° C. (i.e. during drying) or at temperatures above 100° C., preferably not higher than 200° C., during a heat treatement carried out during or after the drying step. Mixtures of different types of agents lowering the surface tension may, of course, be employed.

Such volatile or heat-decomposable agents are usually used only for the last dewatering or washing step, since in intermediate steps it may be desirable to re-use the liquid or foam/liquid mixture drained from the airpermeable sheet material, e.g. in the form of a system where lightly soiled liquid is used in foam form for the dewatering or washing of sheet material containing a higher concentration of soiling or polluting agents, i.e.

agents to be removed from the sheet material (counterflow washing concept). The presense of an agent reducing water surface tension in these cases is desirable because re-foaming (partial or complete, i.e. from a foam having a lower foaming ratio or from a largely air-free liquid) is necessary and should preferably be achieved without the addition of additional amounts of surfactants.

The foam may be produced in any convenience manner; e.g. static systems, which contain few, if any, moving parts, where foam essentially is produced by blowing into the liquid to be foamed through fine orifices to introduce tiny bubbles into water at predetermined air to liquid rates, or dynamic systems, where air is beaten into a liquid by various systems involving rotating parts, e.g. rotating discs (usually serrated along the circumference) arranged on a shaft, one of these discs moving clockwise, the next counterclockwise and so on, or other devices capable of introducing air into a liquid to produce a defined structure for the cells of the foam.

The size of foam cells should preferably be fairly uniform, i.e. very large bubbles should not be present in small cell-sized foam since such a heterogeneous foam may give non-uniform and inconsistent results. Generally speaking the largest cells present in the foam applied should not have a diameter larger than the thickness of the layer of foam to be applied to the airpermeable sheet material and preferably it should be at most half the thickness of the layer. More uniform effects are obtained if the cell size is not larger than a quarter or preferably a tenth of the foam layer thickness deposited.

The concentration of agents capable of reducing the surface tension in the liquid before or during foaming obviously should be kept at the minimum necessary to obtain a foam of suitable foaming rate and foam stability.

The foaming rate is the ratio between the volume of the liquid after foaming to the volume of the liquid to be turned into a foam. A foaming rate of 10:1 thus means that the volume of the foamed liquid is ten times the volume of the unfoamed liquid. Foaming rates between 200:1 and 5:1 may be used, but a range between about 150:1 and 10:1 or preferably between 100:1 and 15:1 have been found most advantageous. The foaming rate obviously will determine the volume of foam to be applied if a given amount of liquid is to be used in the form of foam to dewater airpermeable sheet material. Thicker layers, i.e. higher foaming rates are desirable if the thickness of the sheet material varies due to its structure or surface texture. All surface features of the sheet material to be dewatered or treated should be immersed in the layer of foam to achieve uniform dewatering effects, and thicker layers of foam may be applied if there is a considerable variation between the maximum and minimum thickness of the sheet material.

In one embodiment of the invention, the foam applied to the sheet material to be treated is caused to permeate into and through the structure and interstices between structural elements by causing a pressure gradient to form between the surface to which the foam was applied and the side remote therefrom, the pressure being higher on the foam-coated side. Pressure applied from the side of the sheet material carrying the foam, or vacuum applied to the reverse side, or both, will force the foam to travel at substantially a right angle to the plane of the sheet material.

The use of vacuum has certain advantages over the use of pressure. It is easier to apply in a well defined area on the side opposite the foam location, the vacuum applying means (e.g. a vacuum slot) may be in direct contact with the substrate with no loss of energy since essentially the vacuum acts only on the sheet material/substrate and the foam lying on the sheet material, with little or no air seepage from the outside.

Air pressure applied to the foam on the other hand is much more difficult to direct exclusively onto the foam and through the sheet material (some air will always be diverted due to the fact that the nozzle has to be above the surface of the foam layer). Foam is likely to be blown off the surface of the sheet material instead of through it for the same reason. Removal, collection and draining of the foam/liquid exiting after permeation is much more difficult with air pressure. Another important advantage of vacuum as a pressure gradient-producing medium is the fact that a vacuum slot will stabilise the movement of the sheet material by holding it rather than causing it to flutter as a strong stream of air does. For these and additional reasons such as foam breakdown or a strong decrease of the foaming rate which can be produced by vacuum, but not (at least not to the same degree) by air pressure, and simple recycling of drained liquid/foam, the use of vacuum applied to the side of the air permeable sheet material not carrying the foam is the preferred method for creating a pressure gradient and causing the foam to permeate into and through the sheet material.

The foam emerging from the downstream side of the sheet material is not identical to the foam as applied, since for instance, its foaming ratio is decreased by the water removed from the airpermeable sheet material. Depending on the properties of the foam, it may also be lowered by the permeation process. It may be further decreased (which in many cases is desirable) by adjusting the stability of the foam to the minimum level desirable from the point of view of foam collapse between foam formation, foam deposition on the sheet and the time permeation starts. Passage through porous substrates may also affect the size of foam cells and foam cell size distribution, i.e. the difference in the size of the smallest and the largest cells. Material and agents removed by the foam from the sheet material may also affect the characteristics of the liquid or foam or foam/liquid mixture exiting from the sheet material. Generally speaking, it is desirable to have a low foaming ratio or substantially no foam in the vacuum slot, at least if the liquid is to be discarded. But even if it is recycled, one may have better control over the process if the drained foam or foam/liquid mixture is re-foamed to a predeterminable foaming rate.

In other cases it may be desirable to drain liquid essentially in the form of foam, i.e. to incorporate water removed from the sheet material into the foam permeating through it. In such cases the stability of the foam applied and the foaming ratio (which is lowered by the liquid drained from the sheet) may be suitably adjusted, i.e. the foam stability is increased, the foaming rate preferably being kept at such a level that the foam can be reapplied if desired even without refoaming. In many cases it may be desirable to reduce the foaming rate to virtually zero, i.e. to use conditions and equipment where liquid containing little or no air exits from the system. In this case, one will reduce original foam stability.

In another embodiment of the present invention, a foam flow constraining substrate may be disposed in juxtaposition with the air permeable sheet material to support the same during the foam treatment. The foam flow constraining substrate is preferably juxtaposed the air permeable sheet material on the side remote from that to which the foam is applied. In an alternative embodiment, however, the foam flow constraining substrate may be juxtaposed the air permeable sheet material on the side thereof to which the foam is applied.

Whichever embodiment is employed where a foam flow constraining substrate is used, it is preferably a sheet material having the following characteristics:

1. Ensuring an essentially uniform permeation of air liquid and foam through interstices or pores in the sense that these pores are distributed evenly over the surface of the substrate and that the maximum diameter or cross section of the pores are predeterminable and known magnitude; if the size of the pores is not geometrically definable such as for instance in the case of a non-woven fabric then the air and foam permeabilities may be determined by a large number of small pores and not by a relatively small number of large pores.

2. Ensuring that the air permeability of the substrate material is at the most equal to that of the air permeable sheet material to be treated and preferably, at least 10% lower than the air permeability of the air permeable sheet material.

3. Ensuring that the maximum diameter of these pores is preferably at the most, 50 microns, and more preferably not greater than 30 microns.

The uniformity of the maximum pore size in the foam flow constraining substrate results not only in constraint, but also in equalisation of the flow of foam through the sheet material and said substrate.

The substrate may be a woven fabric or a non-woven web. The construction of the fabric or web should be sufficiently stable to retain the pore characteristics in use.

This is usually easier to achieve in the case of more planar, i.e. less three-dimensional configurations as opposed for instance to knitted structures, which are not only more open, but tend to become distorted (with some pores becoming larger) if exposed to stress. Knitted fabrics for this reason were found to be less suitable, unless the configuration of interlacing yarns and fibres is sufficiently stabilised by blocking fibre-to-fibre and yarn-to-yarn movement (such blocking may also be useful or even necessary in the case of unstable woven fabrics or webs), and provided airpermeability and maximum pore diameters can be held at the levels specified above and below.

The pores or interstices through which the pressure gradient causes the foam to permeate through the airpermeable sheet material and the foam flow-constraining substrate, may be essentially round or square as in the case of a filter fabric, where pore size and pore shape is determined by the open space lying between yarn intersections (the yarn being very compact), or they may have oblong shapes, i.e. they may be formed by single fibres arranged in relatively parallel configurations, such as fibres forming a yarn with a relatively small number of turns per inch. It has been found that woven fabrics consisting in at least one direction of a yarn with a very low twist factor (i.e. few if any turns per inch), where fibres (preferably filament fibres) due to the low number of turns are arranged in an essentially parallel configuration relative to each other and again due to the low twist factor rather form an essentially two-dimensional ribbon or band instead of a three-dimensional yarn with a more or less circular cross-section, are particularly suitable among woven fabrics. Filter fabrics, i.e. fabrics of very tightly woven structures with very compact yarns are suitable due to the very accurate maximum pore size and the wear resistance of such fabrics. While pore size in the case of filter fabrics is defined by the open space between yarn intersections i.e. by the yarn diameter, yarn construction and fabric construction, it is determined by the spacing of the essentially parallel filaments of the ribbon-like low or no twist yarns in the case of the other type of weave mentioned.

In many cases, other woven fabrics, i.e. fabrics containing either low or no-twist yarns, or filter fabric yarns, may be used provided their airpermeability is at most equal, preferably at least 10% lower than that of the sheet material to be dewatered, and provided maximum pore sizes are less than 50, preferably less than 30 microns. Cellulosic, cellulosic blend or synthetic fabrics have under these conditions given adequate dewatering effects.

Filter fabrics made of synthetic filament yarns with a mesh aperture of at most 50, preferably at most 30 microns are suitable for achieving good dewatering effects. If stationary filter plates are used to constrain foam flow, best results are obtained if the maximum pore diameter is 40 microns, preferably 30 microns. Airpermeabilities of at most 4000, preferably at most 2500 liters/square meter/second give acceptable effects in the case of filter fabrics.

In the case of woven fabrics consisting of yarns and fibres which do not give fabric structures with porosity features as well defined as filter fabrics, airpermeability has been found to be the best criterion. Woven fabrics should have an airpermeability (measured in wet state at least if water-swellable fibres are present) of at most 250, preferably at most 200 liters per square meter per second (determined at a pressure equal to the weight of a water column of 20 centimeters). Woven fabrics having an airpermeability of 100 l/sq.m./sec. or even 10 l/sq.m./sec. have given excellent results.

Nonwoven structures for use as the foam flow constraining substrate having a maximum airpermeability of at most 2000, preferably at most 1000 liters per square meter per second give acceptable dewatering effects. It is preferred that the fibres of the web should be suitably spaced, the pores (i.e. open space between fibres) should be distributed over the web in sufficient uniformity and the configuration of the interstices between fibres which define pore size should be sufficiently stable (i.e. if it does not change-affecting pore size and uniformity-under the influence of the pressure gradient and/or actual use).

Uniformity of pore distribution over the area of the substrate and of maximum pore diameters is important because the foam flow-constraining substrate not only serves to constrain the flow of foam by causing the foam to flow through a large number of pores with a relatively uniform maximum pore diameter, but also to equalise the volume of foam forced through the sheet material over its entire surface and the substrate by the pressure gradient in the sense that the thickness of the foam layer is reduced uniformly over the surface of the airpermeable sheet material, i.e. that zero foam layer thickness is reached at virtually the same time all over the surface of the sheet material. If in certain places foam would permeate substantially faster than in others, dewatering effects could become non-uniform because due to the different flow-through properties of foam and air, the areas where zero thickness of the foam layer is reached first would act as by-passes, i.e. the residual foam on the other areas would permeate more slowly or incompletely, thus affecting the removal of water from the sheet material in those areas. The foam flow-constraining substrate thus serves both to channel uniformly the flow of foam and to ensure that the pressure gradient, the flow of foam through the sheet material and hence the dewatering effect is uniform over the surface of the airpermeable sheet material even if the latter due to its structure or configuration should have non-uniform air or foam flow-through properties.

The foam flow constraining substrate may be in close contact with the sheet material to be dewatered, i.e. there should be no open space or gap between the sheet material and the substrate except open space determined by the surface texture of the two sheets, hence the pressure gradient should be acting through both sheets without any appreciable amount of air entering between the edges of the two sheets in the case of vacuum, or air escaping between the sheets if air pressure causes the pressure gradient to form.

In the preferred mode of the invention the airpermeable sheet material, to which a layer of foam is applied travels in close contact with the foam flow-constraining substrate, which thus carries the sheet material, for instance over vacuum slots producing the pressure gradient and which draws the foam lying on top of the airpermeable sheet material through the latter and through the substrate underneath.

This system not only has the advantage that an airpermeable sheet material having little or no mechanical integrity of its own may be treated easily, but that a delicate sheet material (i.e. material sensitive to damage by friction) is not caused or allowed to rub against stationary surfaces such as the edges of a vacuum slot.

At the same time, the system is very versatile in the sense that optimum dewatering effects on sheet material of a wide range of construction, configuration, airpermeability and bulk may be achieved simply by using a suitable foam flow-constraining substrate, by applying a suitable foam and adjusting if necessary the pressure gradient.

Foam flow-constraining substrates may comprise natural or synthetic fibres, blends or inorganic material such as glass or metal fibres or thin wires (wire mesh) provided it has an airpermeability lower than the sheet to be dewatered and preferably a maximum pore size (mesh aperture) of at most 100 micron, preferably lower than 50 microns or even lower than 30 microns. Perforated metal, perforated plastic sheet material, or woven material gauzes may be used provided the specifications mentioned above apply.

Such substrates may be arranged in the form of endless belts, or of rotary screens. Stationary filter plates may also be used if they meet specifications as regards maximum pore size, but the friction created between the sheet material and the filter plate by the movement of the sheet material and enhanced by the pressure gradient may be disadvantageous. The permeability to air of the foam flow-constraining substrate should as mentioned above be lower than the permeability to air of the wet sheet material to be dewatered (in the case of substrates consisting of or containing water-swellable fibres, one should determine the airpermeability in wet state).

Substrates having a very much lower airpermeability than the sheet material to be dewatered may give very good dewatering effects; in fact in most cases, for a given type of substrate, dewatering effects increased (i.e. residual water content decreased) with decreasing airpermeability of the substrate as is shown in Table 1.

It is of course not possible to correlate directly types of fabrics differing basically as regards their foam flow-constraining features, e.g. filter fabrics (where pores are defined by the yarn diameters and yarn spacing) to woven fabrics where the spacing of for instance low twist filamentous fibre material arranged in ribbon-like fashion determines air and foam flow properties, or to nonwoven structures where the orientation, spacing and configuration of fibres and fibre intersections determine pore size. Furthermore, not only the airpermeability, but to an even larger degree the pore size may influence the degree of water removal for a given sheet material.

In the case of filter fabrics (polyester, polyamide or other synthetic fibres), where air and foam flow characteristics as well as pore size are almost exclusively defined by the diameter of the yarns used and hence the mesh count, dewatering performance follows very closely the mesh aperture and to a slightly lesser degree airpermeability as is shown in Table 1.

TABLE 1

| Residual Water | Filter Fabric No. | | | | | | |
|---|---|---|---|---|---|---|---|
| After Dewatering | 31 | 32 | 46 | 39 | 44 | 37 | 41 |
| (% owf) | 130 | 140 | 170 | 180 | 185 | 195 | 195 |
| Mesh aperture | 25 | 26 | 100 | 58 | 80 | 53 | 80 |
| Mesh count | 184.5 | 165.7 | 58.5 | 110.5 | 74.5 | 120 | 81.1 |
| Yarn diameter/cm | 0.030 | 0.035 | 0.070 | 0.033 | 0.054 | 0.030 | 0.043 |
| Open Surface % | 19 | 17¾ | 3.5 | 40 | 35.75 | 41 | 42.5 |
| Air-Permeability $1/m^2/s$) | 2100 | 1250 | 4400 | 4450 | 4400 | 5050 | 6000 |
| Water Permeability ($1/m^2/s$) | 485 | 265 | 780 | — | 770 | 850 | 950 |

The data set out in Table 1 above shows that among filter fabrics those with a mesh aperture higher than 30 removes substantially less water than fabrics with a mesh aperture below 30. The fabrics having the lowest mesh aperture also were those with the lowest air and water permeabilities, the highest mesh count and the lowest open surface.

Such correlation between dewatering effect, mesh aperture, air permeability and mesh count and open surface of filter fabrics and filter plate was found for widely different airpermeable sheet material ranging from tissue paper to nonwoven webs to cotton broadcloth and eight to sixteen layers of cotton gauze. In addition to a mesh aperture of at most 30 microns, a mesh count above 100, preferably above 150, an open surface below about 25, preferably below 20 and airpermeability of less than 3000 l/sq. m./sec. (liters per square meter per second) are factors ensuring a high rate of dewatering.

In certain cases one may, of course, have to compromise as regards the dewatering effect/airpermeability or open area ratio, e.g. if sheet material is moving extremely fast, if it contains very high amounts of water or if for any other reason high permeability of the foam flow-constraining substrate is desirable.

One may for instance prefer to use a more open structure of filter cloth at least in preliminary washing steps to achieve a high flow-through rate.

In the case of woven fabrics with characteristics not as well defined as in filter fabrics, the pore size as mentioned earlier may be determined as much or more by fibre to fibre spacing as by yarn intersection spacing. But even among fabrics of widely different constructions, the structures with the lowest airpermeability give the best dewatering effects as is shown in Table 2.

TABLE 2

| No. | Fabric Constr. | Fibre Material Remarks | Airperm. 1/m /sec. | Resid. Water Content % |
|---|---|---|---|---|
| 10 | Ribs | Nylon, filling yarn with extremely low twist factor | 10 | 95 |
| 3 | Twill | Cotton | 15 | 120 |
| 11 | Plain Weave | Polyamide parachute cloth, filament yarns, very light weave | 200 | 130 |
| 13 | Plain Weave | Polyester, staple fibre yarn | 250 | 150 |
| 18 | Broad-Cloth | Cotton | 280 | 175 |
| 14 | Plain Weave similar to No. 13 | Polyester | 300 | 195 |
| 5 | Nonwoven | Polyester | 1200 | 160 |

*Fabric dewatered: Nonwoven, air-tangled.

Since there are hardly any methods known for defining, let alone determining "pore aperture" for fabrics of widely different construction, yarn characteristics, and yarn configurations, the airpermeability (determined in wet state if water-swellable fibres are present) is the most meaningful and universally applicable rating criterion as regards dewatering effects obtainable.

Another method is the so-called bubble-point test used by producers of filter cloth to define "nominal pore size".

In the case of woven fabrics, for instance a nominal pore size (as determined by the bubble point test) of at most 30, preferably at most 20 gives the best dewatering effects if these fabrics are not filter type fabrics.

It is also a useful method for evaluating the effect of mechanical or other treatments which may be applied to improve the dewatering properties of a given fabric (such as calendering, and shrinking).

Nonwoven fabrics have been used with average results for dewatering, provided the configuration of fibres and fibre intersections are well fixed by proper bonding to avoid distortions leading to uneven pore size distribution, and provided the web is uniform as regards pore size and pore distribution in the material. Such nonwovens which may be used to give average dewatering effects as shown in Table 2, since the average pore size may have much higher airpermeability than conventional woven fabrics (but usually lower than filter fabrics).

In preferred embodiments of the present invention, the characteristics of the foam should be selected such that:

1. a foaming rate of the foam applied to the surface of the airpermeable sheet material of 300:1 to 5:1 may be used; better results may be obtained if this range is between 150:1 to 15:1, with about 80:1 to 20:1 being the optimum range for most applications.

2. The volume of foam applied to the sheet material and caused to permeate through it should be such that the foaming rate calculated from the weight of liquid initially applied in foamed form, of this foam and the liquid removed from the airpermeable sheet material is 10% to 80%, preferably 30% to 60% lower than the foaming rate of the foam originally applied. It is, of course, desirable to use as little liquid for the dewatering as possible. Depending on the characteristics of the sheet material to be dewatered (evenness of the surface, thickness, openness, amount of water to be removed, time available for permeation, pressure gradient available), a high, medium or low foaming rate may be more advantageous.

3. In order to get good dewatering effects at low add-on and low foam volumes existing in the system, foam stability levels, foam volumes applied, foaming rates of the foam applied and pressure gradients used as well as the characteristics of the foam flow-constraining substrate should be selected in such a way that the actual foaming rate of the foam/liquid mixture exiting from the foam flow-constraining substrate is less than 50%, preferably less than 20% of the foaming rate of the foam originally applied to the surface of the airpermeable sheet material.

While the change of the foaming rate specified in 2. may be calculated, the change specified in this paragraph is actual, i.e. to be determined by measuring the volume and the weight of the foam/liquid mixture before and after permeation.

This reduction of the actual foaming ratio may be increased by using a foam of low stability, a relatively low foaming rate and pressure gradients and foam flow-constraining conditions conductive to a relatively high degree of foam breakdown.

4. If an even lower foaming ratio or practically no foam is desirable at the exit end of the system, the foaming rate may be further reduced by carrying the foam/liquid mixture under the action of the pressure gradient, preferably vacuum, through a pipe or tube equipped with at least one venture having at least one segment where the cross-section of the tube or pipe narrows suddenly by at least 5% preferably at least 25% of the cross-section. Virtually untapered narrowing sections, i.e. sections where the cross section narrows rather abruptly are more advantageous than long tapered sections.

5. Good dewatering effects are obtained while lowering foaming ratios, i.e. the volume of foam leaving the system, by adjusting the stability of the foam applied to the airpermeable sheet material to such a level that this stability expressed in terms of foam half-life is reduced by at least 25%, preferably at least 50% by the passage through the sheet material and the associated foam flow-constraining substrate and by the dilution produced by the liquid removed by the treatment from the sheet material. This particularly applies if vacuum is used to produce a pressure gradient.

"Half-life" as applied to foam in this specification means the time after which the volume of a foam put into a beaker at 20° C. has dropped to 50% of the original volume, half of the foam volume thus having collapsed.

Some of the reduction of foam stability may be produced by the passage through the porous sheet material and the substrate, while some foam stability loss is due to the dilution occuring inside the wet airpermeable sheet material. In most cases foam stability loss, irrespective of its cause, is a useful criterion for the selection of processing conditions, in particular of the stability of the foam originally applied. The stability is determined not only by the type and concentration of the agent reducing surface tension present in the foam, but also by the foaming rate and to some degree by the shape and size of foam cells, in particular by their maximum size. This gives a wide range of options as regards the formulation of the foam and the optimization of the formulation from the point of view of other criteria mentioned.

The magnitude of the pressure gradient depends on processing conditions and the sheet material to be treated (i.e. time available for permeation; volume of foam applied per area, e.g. per square centimeter; structure, weight, density, thickness of the sheet material; and amount of liquid to be removed). Practically all the foam applied to the surface of the sheet material should be caused to permeate into, preferably all through, the entire thickness of the sheet material.

The time of exposure of the airpermeable sheet material, to which foam had been applied, to the pressure gradient preferably is such that virtually all of the foam applied is caused to permeate through said sheet material. If, for some reason, a layer of foam is to be left, or if the action of the pressure gradient is to be terminated before all the foam has been removed from the surface to which it had been applied, the residual layer of foam may be removed, for instance, by scrapping or by suction.

Permeation of the foam through the sheet material under the action of the pressure gradient may proceed in one or several steps, with one or several applications of foam to the surface of the sheet material to be treated, with the same or a different type and the same or a different magnitude of the pressure gradient causing permeation of the foam. As mentioned before, the preferred method for causing permeation consists in applying vacuum to the wet airpermeable sheet material through the foam flow-constraining substrate, which is in close contact with said sheet material and which by the action of the vacuum and the air-pore plugging action of the foam layer present on the surface of the airpermeable sheet material, is even more tightly contacted with said substrate.

Vacuum for instance may be applied to the system by passing the foam flow-constraining substrate and the superimposed airpermeable sheet material across one or several slots, such a "vacuum slot" comprising an enclosed area which is connected through a tube, pipe or duct to a vacuum-producing pump. Multiple vacuum slots may be arranged in a horizontal plane, a curve (preferably convex) or in a rotating drum, the sheet material and the underlying substrate preferably travelling horizontally or at most at an angle of 90°, preferably at most 60° to the horizontal plane. While the most advantageous configuration consists in applying the pressure gradient, in particular vacuum, to the foam flow-constraining substrate having a lower and preferably a more even airpermeability than the airpermeable sheet material, and through this substrate to the airpermeable sheet material, one may if desired apply foam to the foam flow-constraining substrate, which travels (preferably with the same speed) in close contact on the wet airpermeable sheet material, and apply the pressure gradient, in particular vacuum in such a way that the foam is made to permeate through the substrate, then through the underlying sheet material to dewater the latter. This configuration as an alternative to the preferred one where the foam is applied to the airpermeable sheet material, may in certain cases also be used for the washing application described below, at least in some of a series of in-line dewatering steps. Dewatering effects are, however, inferior to those obtained by applying the foam to the air/permeable sheet.

The process according to this invention may also be used to remove agents from the air/permeable sheet material. Such agents may be chemical agents, particulate matter, liquids, solids or mixtures of such products including impurities of undefined composition. In these cases, the foam applied to the surface of the sheet material (or the substrate) acts as washing medium, which removes undesirable agents and at the same time dewaters the sheet material so that a second step under the same or different conditions will be more effective as regards the agent removal effect. The air/permeable sheet material may be dry when foam is made to permeate it for the first time to remove agents, or it may be wet as in the case of dewatering. The foam applied may contain surfactants particularly suitable for removing the undesirable agents present, and/or it may contain compounds capable of neutralising, emulsifying or dispersing the undesirable agents present in th sheet material.

As in the case of dewatering, multiple treatments according to the invention may be carried out in the same or in a different configuration, under the same or different conditions as regards the type, composition and properties of the foam used, the pressure gradient employed, etc. To obtain maximum cleaning effects, it is important to operate under conditions ensuring good dewatering effects. A further aspect of of the present invention is the inclusions within the foam of agents which interact with the airpermeable sheet material or with material carried therein, "interacting" meaning reacting chemically with said material or components thereof, forming covalent or non-convalent bonds (such as hydrogen or Van der Waals bonds) or just agents for deposited in the interstices of the said sheet material.

Such interaction treatments may be carried out independently or in combination with agent removal and dewatering treatments.

The foam may be applied to a dry air permeable sheet material, in particular foam may be forced into the dry airpermeable sheet material to form an inner interface under conditions (in particular as regards the absorbency of the substrate for the liquid forming the foam cells), which enable foam transit through the substrate. This is particularly beneficial in cases where (i) foam collapse by water adsorption by the material of the airpermeable sheet material is to be prevented (i.e. if the water content of the latter in the case of removal of undesirable agents or the application of agents is relatively low (dewatering thus being necessary only after agent removal or agent application);

(ii) if for other reasons a minimum amount of water is to remain in the airpermeable sheet material;

(iii)if interaction with the material of the airpermeable sheet is desired to take place within its structure, i.e. if interaction is to proceed at inner interstices (and if desired also at the surface interface), foam may be forced into the dry airpermeable sheet material to form an inner interface under conditions (in particular as regards the absorbency of the substrate for the liquid forming the foam cells), which enable foam transit through the substrate.

In these circumstances, the foam thus applied may contain agents capable of producing the interaction desired, or if such agents are applied subsequently, interaction will take place not only at the surface to which such agents are applied, but also internally at any inner interfaces which may be formed. Foam transition conditions are determined and achieved by causing a sheet of foam of uniform thickness to permeate through the airpermeable sheet material under the action of a pressure gradient, the sheet material being exposed to the action of this pressure gradient only for such a period of time until the first foam cells appear on the opposite side of the sheet material.

The foam flow-constraining substrate may be cleaned in order to remove particulate or fibrous debris carried by permeating foam from the airpermeable sheet material into the substrate or already present in the foam when it was applied, by reversing the flow direction (using foam, water, spraying of water, air blown against the substrate) after the substrate has been separated from the airpermeable sheet material.

Water, foam or air is thus pressed through the substrate from the side which had not been in touch with the sheet material, i.e. where the pressure had been lower during the treatment according to the present invention. If water/soluble material has to be removed from time to time or after each cycle of foam permeation, washing may either proceed by reversing the flow direction or using the same direction as before. If soiling or clogging by debris is very severe, one may use different foam flow-constraining substrates in-line, i.e. transfer the airpermeable sheet material from one substrate to another between treatments involving foam permeation.

Following is a description by way of example only of methods of carrying the invention into effect.

The following data demonstrates the strong beneficial effects of the process of the present invention.

In the examples, the following explanations and abbreviations will be used.

FFCS: Foam flow constraining substrate
APSM: Air-permeable sheet material
MEF (APSM)
Blott-Paper (APSM)
Tissue (APSM)
Gauze (APSM) 8 layers of surg. gauze, bleached and scoured, . . .
Broadcloth (APSM)

Foam Formulations and Specifications ("Foam")

Blow ratio: volume of foamed liquid to volume of liquid before foaming
Formulation: Agents present in liquid to be foamed
Formulation A: 2 grams/litre of nonionic surfactant (Sandozin NIT conc, Sandoz)
Formulation B: 1 gram/litre of same nonionic surfactant
Formulation C: 0.2 grams/litre of same surfactant
Foam Volume: Volume of foam (in ml) applied to surface of APSM before applying pressure gradient volume in ml per dm2.
Dewatering Effect:

Bath content of APSM after applying foam, creating a pressure gradient causing the foam to permeate through the APSM and the FFCS, and determining and comparing the weight of the APSM sample after this treatment to its weight before the treatment, expressed in %owf (% on the weight of the fabric).

Residual Water Content:

Water content of APSM after dewatering treatment (as opposed to "original water content", i.e. water content before dewatering treatment).

EXAMPLE 1

Effect of Presence of Foam in Multi-Layer Substrates (Woven Fabrics)

Processing and handling of fabrics in the tests: Two or more superimposed layers of the textile fabrics mentioned were treated in wet state (pure water) as follows (a) Hard squeeze in nip between rollers, double passage, i.e. mangling repeated (b) same, light squeeze, one and two passages, (c) same, but foam applied to the layers of fabric (between layers) before same squeeze as in (b), only one passage.

The effects obtained are expressed in grams of fabric plus residual water per $100^2$ cm.

The presence of agents lowering the surface tension of water per se has been found to increase the effect of known mechanical water removal systems such as squeezing in a nip etc., particularly if the water-removing treatment has to be mild from the point of view of mechanical action, e.g. mechanical pressure applied to the sheet material.

Applying such agents in a foam bath will, however, further reduce the residual water content to a very substantial degree as shown in the following Table 3.

TABLE 3

| Non-woven, 2.15 oz/sq yard, 100% rayon | |
|---|---|
| Sample 1 | two layers of the non-woven padded in pure water, squeezed gently in mangle |
| Sample 2 | padded in water containing agent capable of lowering surface tension of water, squeezed on same mangle in same way as Sample 1 |
| Sample 3 | same treatment as for Sample 2, but foamed bath (same composition as padded bath) fed between the two layers of non-woven before squeezing |

| | | Residual Water Content |
|---|---|---|
| Sample 1 | | 200% |
| Sample 2 | (0.25% surfactant) | 130% |
| Sample 2 | (0.01% surfactant) | 180% |
| Sample 3 | (0.25% surfactant) | 110% |
| Sample 3 | (0.01% surfactant) | 160% |

Since in certain cases it is undesirable to have residual surfactants present on the sheet material after drying, it has been found that in such cases one may use surfactants decomposing under the influence of drying temperatures, or carried off by the evaporating water, or surfactants which have an evaporation temperature not much higher than water.

TABLE 4

| | 100% cotton broad cloth (2 layers) | 100% cotton voile (2 layers) | cotton gauze (16 layers) |
|---|---|---|---|
| (a) Hard squeeze 2 passages | 4.12 g | 2.32 g | 9.3 g |
| (b) Light squeeze one passage | 5.2 g | 3.84 g | 11.7 g |
| (b) Light squeeze two passages | 5.12 g | 3.85 g | 11.62 g |
| (c) (b) treated with foam one passage of treatment (b) | 4.5 g | 3.09 g | 9.9 g |

The treatment (c) of a sample given the nip treatment (b) followed by the same nip treatment in presence of a bath of foam thus gave a residual water content considerably lower than either treatment (b) alone or the repeating of treatment (b), i.e. the presence of the foam in the fabrics during the squeezing treatment improved the squeezing effect very substantially even though the treatment with foam had increased the water content beyond that of the wet material used for the test.

EXAMPLE 2

Influence of Air Pass-through Treatment: Woven Multilayer Substrates

The same samples as in Table 3 were after squeezing treated for 10 seconds thereafter with a relatively slow stream of air blown against one face of the sandwiched fabrics.

TABLE 5

| | Broadcloth (2 layers) | Voile (2 layers) | Gauze (16 layers) |
|---|---|---|---|
| (b) one passage through nip | 5.2 g | 3.88 g | 11.72 g |
| (c) one passage | 4.5 g | 3.09 g | 9.9 g |
| (b) after squeezing treated with air (room) temperature) | 4.95 g | 3.60 g | 11.5 g |
| (b) after squeezing treated with air of 32° C. | 4.8 g | 3.3 g | 11.5 g |
| (c) after squeezing treated with air (room temperature) | 4.38 g | 2.84 g | 10.05 g |
| (c) after squeezing treated with air (32° C.) | 4.28 g | 2.42 g | 9.94 g |

These results show that the short treatment with air gives surprising results even if the air is at or only slightly above room temperature—irrespective of the number of layers present and even though rather low air speeds are used.

In some cases water levels are reached even under these very mild conditions, which are comparable to these obtained by very hard squeezing. Higher air temperatures such as 60° to 80° C. and somewhat higher air speeds (yet well below the very high speeds used in nozzles as recommended by certain equipment manufacturers) do of course give even better results even at shorter treating times. Air temperatures of 40° to 80° C. are available at low cost from heat recovery systems of tenter frames, curing ovens or other thermal treating equipment. Air or water at such temperatures was considered to be of little use hitherto.

EXAMPLE 3

Influence of Presence of Foam on Squeezing Effect: Multilayer Non-woven Substrates

Procedure

Non-woven substrates (rayon, entangles) were wetted in an aqueous bath containing small amounts (0.2 g/liter) of a non-ionic detergent. Control sample A was squeezed hard twice in sandwich form in the nip of a padding mangle. Control Sample A' was squeezed lightly in sandwich form in the nip of a mangle.

Sample $B_1$ was treated exactly as samples A, but after the squeezing in the nip the same bath in foamed form was sucked through the squeezed fabric by means of a vacuum slot.

Sample $B_2$ was again treated in sample A, but a foamed bath of the same composition was fed into the space between two layers of the squeezed non-wovens before the sandwich entered the same nip as for sample A, i.e. during the mechanical treatment (squeezing) additional liquid in foamed form was present in the wet non-wovens.

Sample $B'_1$ was treated exactly as sample A', but after the light squeezing the foamed bath was sucked through the two layers by means of a vacuum slot.

Sample $B'_2$ was treated exactly as sample A', but after the squeezing, the foamed bath was introduced between two layers of the squeezed non-wovens before passing the foam filled sandwich through the same nip as for sample A'.

TABLE 6

| Air treatment: 5 seconds, air temperature 42° C. | | | | |
|---|---|---|---|---|
| Sample | Foaming Rate | Treatment | % Water retained owf | % Water after Air Treatment |
| A | — | hard squeeze, 2 passages | 120% | — |
| $B_1$ | 30:1 | same, then foamed bath sucked through | 120% | 100% |
| $B_2$ | 80:1 | same squeeze sandwiched/foam inserted/squeeze as A | 125% | 100% |
| A' | — | light squeeze | 230% | — |
| $B'_1$ | 25:1 | same, then foamed bath sucked through | 135% | 110% |
| | 50:1 | same | 120% | 100% |
| | 70:1 | same | 110% | 70% |
| $B'_2$ | 25:1 | same squeeze sandwiched/foam | 120% | 110% |
| | 50:1 | inserted/squeezed as A' | 110% | 100% |

Table 6 shows that the sucking of the foamed bath through the wet material may reduce the water content by more than 50% (even though the foam actually adds water to the water already present) and the feeding of the foamed bath between two wet fabrics before squeezing also reduces the water content even though here again the foamed bath actually increases the total amount of water present. The table also shows that a very short treatment with low temperature air will further markedly reduce the water content.

A very important step of the procedure is to insert foamed liquid between layers of wet air permeable sheet material, and then causing the foam to penetrate the sheet structure and remove liquid by passing the layers with foamed liquid sandwiched between the layers through the nip of pressure rollers, i.e. rollers running in contact under adjustable pressure.

The application of the foam may be by known methods (knife, roller, kiss coating, from a trough or from perforated tubes to one or multilayered sheet material such as fabrics—woven, knitted, non-woven—paper, air permeable sheets of foam etc.).

The foam may be applied from one side, from both sides or between layers of the sheet material. The foamed liquid may be aqueous, containing small amounts of foaming agents, or it may contain agents such as foam stabilizers, agents destabilizing foams at elevated temperatures, and finishing agents. It may be applied cold or have a temperature above room temperature. In certain cases non-aqueous liquids may be used.

Known systems capable of removing water from wet material may be used. Not only may the application of the foam be integrated into the permeation step, but the permeation process may be integrated into the liquid elimination process. One may for instance apply foam between layers of multilayered sheet material (e.g. two, four or up to twenty layers of fabrics, the foam usually being applied between middle layers), and then the material passed through the nip of a mangle, forcing the foam into the structure and eliminating liquid in the same treatment.

EXAMPLE 4

Influence of Presence of Foamed Bath on Water Removal (non-Wovens)

TABLE 7

| Samples | Foaming | % Water retained owf | Treatment |
|---|---|---|---|
| A | — | 110% | hard squeeze |
| $B_1$ | 30:1 | 100% | same, then foam sucked through |
| $B_2$ | 80:1 | 110% | hard squeeze, foam fed into sandwich, same hard squeeze |
| A' | — | 230% | light squeeze |
| $B'_1$ | 25:1 | 100% | same, foam |
| | 50:1 | 90% | sucked through |
| | 70:1 | 85% | |
| $B'_2$ | 25:1 | 110% | light squeeze, foam |
| | 70:1 | 105% | fed into sandwich, same light squeeze |

EXAMPLE 5

Water vs foam: Water sucked through APSM vs same volume of water in foamed form sucked through same APSM TABLE 8a

| FFCS APSM | Dewatering Effect in % owf No. 10 Gauze (8) | No. 10 MEF | No. 10 Blott-P. | No. 10 Tissue |
|---|---|---|---|---|
| Formulation[1] | (11) 115% | (11) 120% | (11) 120% | |
| Water | (27) 115% | (118) 110% | (104) 200%* | |
| sucked through | | | (118) 120% | |
| same water[1] | (11) 90% | (11) 80% | (11) 95% | (10) 78% |
| sucked through | (27) 90% | (118) 80% | (104) 150%* | |
| as foam (60:1) | | | (118) 90% | |
| Strong | (11) 110% | (11) 120% | — | (10) 138% |
| Mangling | (27) 110% | (118) 120% | | |

[1]Formulation A

*7 layers, other test with one layer

TABLE 8b

| FFCS APSM | Influence on Surfactant in Water No. 10 Blott P. | No. 10 MEF | No. 10 Gauze (8×) | No. 10 Fibre Stock (2 layers of surgical cotton) |
|---|---|---|---|---|
| Plain water sucked through | (11) 160% | (11) 280% | (11) 130% | (15) 280% |
| Water + Surf. (Form. A) sucked through | (11) 120% | (11) 110% | (11) 110% | (15) 340% |
| Form. A foamed (60:1) sucked through | (11) 90% | (11) 80% | (11) 90% | (15) 135% |

EXAMPLE 6

Influence of Mesh Aperture of the FFCS (Test 109)

The influence of the mesh aperture of different FFCS on dewatering effects obtained on different substrates was investigated.

FFCS: Filter plates in Buchner funnels as model for FFCS

APSM:

Blotting paper (numbers trial No.)

Tissue

MEF

Residual Water Content

| Foam Specs<br>Blow ratio 60:1<br>Formulation A<br>Foam Volume: 300 ml/dm2 | with filter plate I<br>(mesh ap. 40–100 micron)<br>as FFCS | with filter plate II<br>(mesh ap. 16–40 micron)<br>as FFCS | with filter plate III<br>(mesh ap. 10–16 micron)<br>as FFCS |
|---|---|---|---|
| MEF (109) | 180% | 100% | 75% |
| Blott P. (109) | 115% | 95% | 85% |
| Tissue (109) | 135% | 98% | 68% |
| Gauze (111) | 120% | 90% | 79% |

Same tests, FFCS No. 10 superimposed on filter plates I, II and III.

| | Filter Plate I | Filter Plate II | Filter Plate III |
|---|---|---|---|
| MEF (109) | 82% | 85% | 84% |
| Blott.Paper (109) | 98% | 95% | 100% |
| Tissue (109) | 80% | 85% | 85% |
| Gauze (113) | 90% | 86% | 86% |

The FFCS in direct contact with the APSM determines predominantly the dewatering effect.

| | Water content prior to dewatering |
|---|---|
| MEF | 150–160% |
| Blott.Paper | 140% |
| Tissue | 160–170% |
| Gauze | 130–150% |
| | **Water content after Strong Mangling (2 passages)** |
| MEF | 140% |
| Blott.Paper | 95% |
| Tissue | 135% |
| Gauze | 105% |

EXAMPLE 7

Influence of FFCS: Dewatering Effect in % owf

| APSN<br>Formulation A<br>Foam. Rate<br>60:1 | Fibre Stock[1] | | MEF | | Blott. Pap. | | Tissue | | MEF | |
|---|---|---|---|---|---|---|---|---|---|---|
| FFCS | none | No. 10 | none | No. 10 | None | No. 10 | None | No. 10 | None | Wire-screen |
| Dewat. Eff. | 190% | 138% | 195% | 85% | 115% | 98% | 135% | 80% | 24% | 66% |
| (Trial) | (15) | (15) | (120) | (120) | (109) | (109) | (109) | (109) | * | * |

[1]two layers of surgical gauze
*dynamic test (continuous treatment)

EXAMPLE 8

Relation Air of Permeability/Dewatering Effect of FFCS (Trial 33)

APSM: MEF

Formulation A
Blow Ratio 65:1

| FFCS No. | Air Permeability ($1/m^2/sec$) | Dewatering Effect (% owf) |
|---|---|---|
| | **8a Filter Fabrics ZF** | |
| 32 | 1250 | 139% |
| 31 | 2100 | 138% |
| 46 | 4100 | 175% |
| 44 | 4400 | 185% |
| 37 | 5000 | 190% |
| | **8b Nytal Filter Fabrics** | |
| 56 | 50 | 73% |
| 55 | 300 | 96% |
| 54 | 850 | 110% |
| 53 | 1900 | 118% |
| 52 | 2050 | 130% |
| 51 | 2900 | 185% |
| | **Monofilament Filter Fabrics** | |
| 67 | 20 | 150% |
| 66 | 50 | 184% |
| 64 | 350 | 210% |
| 63 | 1100 | 225% |
| | **Other Fabrics** | |
| 10 Nylon | 20 | 95% |
| 3 Cotton | 22 | 120% |
| 11 | 188 | 128% |
| 13 | 220 | 150% |
| 18 | 280 | 177% |
| 14 | 300 | 195% |

EXAMPLE 9

Relation between Mesh Aperture/Open Surface/Air Permeability to Dewatering Effect APSM=MEF,
Formulation A,
Blow Ratio 60:1

| FFCS No. | Dewat. (% res. water) | Mesh Apert. micron | Mesh Count/cm | Thread Diam. (mm) | Open Surface | Air Permeab. | Water Permeab. | Bubble Point "real mesh aperture" |
|---|---|---|---|---|---|---|---|---|
| 31 | 132 | 25 | 184.5 | 0.030 | 19 | 2100 | 485 | — |
| 32 | 142 | 26 | 165.7 | 0.035 | 17¾ | 1250 | 265 | — |
| 46 | 172 | 100 | 58.5 | 0.070 | 35 | 4100 | 690 | — |
| 44 | 185 | 80 | 74.5 | 0.054 | 35¾ | 4400 | 770 | — |
| 37 | 196 | 53 | 120.2 | 0.030 | 41 | 5050 | 850 | — |
| 56 | 73 | 5 | 101.0 | 2 × 0.045 | 1 | 50 | 9 | — |
| 55 | 97 | 10 | 190.0 | 0.042 | 3½ | 300 | 80 | — |

-continued

| FFCS No. | De-wat. (% res. water) | Mesh Apert. micron | Mesh Count/cm | Thread Diam. (mm) | Open Surface | Air Permeab. | Water Permeab. | Bubble Point "real mesh aperture" |
|---|---|---|---|---|---|---|---|---|
| 54 | 117 | 15 | 204.1 | 0.034 | 9½ | 840 | 50 | — |
| 53 | 119 | 25 | 182.0 | 0.030 | 20¾ | 1910 | 450 | — |
| 52 | 133 | 30 | 153.8 | 0.035 | 20¾ | 2050 | 470 | — |
| 51 | 184 | 53 | 72/104 | 2 × 0.043 | 21 | 2835 | 585 | — |
| 67 | | 18 | | | | 12 | 8 | 395 |
| 66 | | 19 | | | | 40 | 10 | 361 |
| 65 | | 32 | | | | 85 | 25 | 223 |
| 64 | | 57 | | | | 350 | 75 | 125 |
| 63 | | 72 | | | | 1100 | 230 | 97 |

EXAMPLE 10

Influence of Configuration on Dewatering Effect (Air Permeability APSM/FFCS)

To investigate the influence of the ratio of APSM to FFCS air permeability three fabrics used as FFCS in other experiments were alternatively used as APSMs and FFCS in pairs, and dewatering trials with foam formulation A were carried out (volume of foam: 300 ml/dm$^2$, blow ratio 60:1).

Fabrics used

FFCS No. 18, air permeability 28 ltr/m$^2$/sec
FFCS No. 3, air permeability 4.4 ltr/m$^2$/sec
FFCS No. 10, air permeability 2.7 ltr/m$^2$/sec $$\text{"Ratio"} = \text{ratio } \frac{\text{air permeability } APSM}{\text{air permeability } FFCS}$$

Test 10*a:*
No. 18 as APSM
No. 3 as FFCS
Test 10*b:*
No. 3 as FFCS
No. 18 as APSM
Test 10*c:*
No. 18 as APSM
No. 10 as FFCS
Test 10*d:*
No. 10 as APSM
No. 18 as FFCS
Test 10*f:*
No. 3 as FFCS
No. 10 as FFCS

Results

| | | Residual Water Content % owf | | | | | |
|---|---|---|---|---|---|---|---|
| | | No. 18 | | No. 3 | | No. 10 | |
| | Ratio | as APSM | as FFCS | as APSM | as FFCS | as APSM | as FFCS |
| 10a | 6.4 | 54% | — | — | 77% | | |
| 10b | 0.16 | — | 62% | 76% | — | | |
| 10c | 10.0 | 54% | — | | | — | 23% |
| 10d | 0.09 | — | 59.7% | | | 24% | — |
| 10e | 0.6 | | | — | 73% | 21.5% | — |
| 10f | 1.62 | | | 71% | — | — | 23.6% |

The results show that a ratio higher that 1 tends to give better results than a configuration where the APSM has an air permeability substantially lower than that of the FFCS

EXAMPLE 11

Influence of Blow Ratio on Dewatering Effect

11*a:* (9)
FFCS: No. 10
APSM:MEF
Formulation A
Volume of foam constant, weight of liquid variable. Volume of foam 300 ml/dm$^2$.

| Blow Ratio | 300 | 150 | 100 | 75 | 60 | 50 | 38 | 30 |
|---|---|---|---|---|---|---|---|---|
| Dewat. Effect (a) | 115% | 100% | 90% | 80% | 75% | 70% | 68% | 68% |
| Dewat. Effect (b) | 95% | 85% | 68% | 67% | 65% | 63% | 63% | 62% |

(a) low vacuum exposure time
(b) double vacuum exposure time of (a)

11b: (12)
FFCS: No. 10
APSM:MEF
Formulation A
Volume of foam varied, weight of liquid foamed constant (1 g/dm$^2$)

| Blow ratio | 450 | 400 | 300 | 200 | 50 |
|---|---|---|---|---|---|
| Dewat. Effect | 98% | 90% | 80% | 82% | 73% |

11*c:* (10)
FFCS: Mesh Apert. 40–100 micron
APSM: Tissue, Blotting Papier, Formulation A and C
Volume of foam constant, weight of foamed liquid variable

| Blow ratio | 300 | 75 | 50 | 30 |
|---|---|---|---|---|
| Blott. Paper | | | | |
| Form. B | — | 100% | 102% | — |
| Form. C | 102% | 102% | 92% | — |
| Tissue | | | | |
| Form. B | 75% | — | 75% | — |
| Form. C | 80% | — | — | 78% |

11d:
FFCS, Mesh Aperture 40 - 100
APSM: Gauze (8x)
Formulation A
Foam volume constant (200 ml), weight of foam liquid varied

| Blow Ratio | 200 | 165 | 120 | 60 | 40 | 20 |
|---|---|---|---|---|---|---|
| weight of liquid | 0.6 g | 1.2 g | 1.7 g | 3.4 g | 4.5 g | 9 g |
| Dewat. effect | 135% | 132% | 136% | 125% | 116% | 110% |

EXAMPLE 12

Influence of Volume of Foam

12(11)
FFCS: No. 10
APSM:
Blotting Paper
MEF
Gauze
Formulation A
Blow Ratio 60:1

| Foam Volume (ml/dm²) | Dewatering Effect (Resid. water % owf) | | |
|---|---|---|---|
| | Blott. Paper | MEF | Gauze |
| 100 | 95% | 80% | 93% |
| 200 | 95% | 80% | 90% |
| 400 | 105% | 80% | 90% |
| 600 | — | 80% | — |
| 700 | — | 80% | — |

12b: (27)
FFCS: No. 10
APSM: Gauze
Formulation A
Blow Ratio: 65:1

| Foam Volume (ml/dm²) | Dewatering Effect (Resid. Water owf) |
|---|---|
| 100 | 92% |
| 200 | 91% |
| 300 | 90% |
| 400 | 89% |
| 500 | 95% |
| 50 ml water (not foamed) | 113% |

12c: (118)
FFCS: No. 10
APSM:
MEF
Blotting Paper
Formulation A
Blow Ratio: 60:1

| | Foam Volume (ml/cm²) | | | | | |
|---|---|---|---|---|---|---|
| | 100 | 200 | 400 | 600 | 700 | Residual Water Mangle-treated |
| | Resid. Water (% owf) | | | | | |
| MEF | 80% | 80% | 80% | 80% | 80% | 110% |

-continued

| | Foam Volume (ml/cm²) | | | | | |
|---|---|---|---|---|---|---|
| | 100 | 200 | 400 | 600 | 700 | Residual Water Mangle-treated |
| | Resid. Water (% owf) | | | | | |
| Blott. Paper | 93% | 94% | 105% | | | 120% |

EXAMPLE 13

Influence of Surfactant Concentration (Foam Stability)

13a: (13)
FFCS: No. 10
APSM: Tissue (handkerchief)
Blow Ratio: 50:1–70:1
Formulations A and C

| Foam Volume (ml/dm²) | 100 ml Form. A | Form. C | 200 ml Form. A | Form. C |
|---|---|---|---|---|
| Resid. Water (% owf) | 102% | 96% | 102% | 96% |

13b: (10)
FFCS: No. 10
APSM:
Blotting Paper
Tissue
Blow Ratio: Varied
Formulations B and C

| | Blow ratio | | | | | | | |
|---|---|---|---|---|---|---|---|---|
| | 300 | | 75 | | 50 | | 45–40 | |
| | Form. B | Form. C | Form. B | Form. C | Form. B | Form. C | Form. B | Form. C |
| | Resid. Water (% owf) | | | | | | | |
| Blott. Paper | — | 102% | 102% | 100% | — | — | 105% | 72% |
| Tissue | 72% | 78% | — | — | 72% | — | — | 78% |

13c: (123) Foam Collapse Time (with and without vacuum)

| | | Foam Collapse Time | | | |
|---|---|---|---|---|---|
| | | under vacuum | | room pressure | |
| Surfactant | Concentr. g/litre | seconds | minutes | seconds | minutes |
| Sandozin | 15 | — | 15 | — | >60 |
| NIT | 2 | — | 7 | — | 55 |
| (Sandoz) | 1 | — | 9 | — | 52 |
| | 0,2 | — | 32 | — | 42 |
| | 0,1 | 45 | — | — | 30 |
| Irgapodol FA | 1 | — | 5 | — | 15 |
| (. . .) | | | | | |
| Irgapodol | 1 | 105 | — | — | 40 |
| FC | 0.1 | 42 | — | — | 30 |
| Gafac | 1 | — | 7 | — | 40 |
| IRA600 | 0,1 | 160 | — | — | 30 |
| Sandopan | 2 | 73 | — | — | 40 |
| DTC | 1 | 62 | — | — | 50 |
| | 0.2 | 30 | — | — | 17 |
| | 0.1 | 32 | — | — | 25 |

EXAMPLE 14

Influence of Initial of Water Content of FFCS on Dewatering Effect on APSM

14a: (103)

FFCS: No. 10
APSM: Gauze
Formulation A
Blow Ratio: 60:1

| | | | | | |
|---|---|---|---|---|---|
| Water Content FFCS before Dewatering | 0% | 23% | 40% | 55% | 75% |
| Dewat. Eff. on APSM (Res. Wat. owf) | 110% | 105% | 103% | 102% | 100% |

14b:
FFCS: No. 10
ASPM: MEF
Formulation A
Blow Ratio: 60:1

| | | | | | |
|---|---|---|---|---|---|
| Water content FFCS before Dewat. | 0% | 25% | 30% | 40% | 50% |
| Dewat. Eff. on APSM (res. water owf) | 108% | 110% | 102% | 105% | 106% |
| Foam Content (% owf) on FFCS before Dewat. | | 20% | | 45% | |
| Dewat. Eff. on APSM (res. wat. cont. owf) | | 100% | | 105% | |

EXAMPLE 15

Influence of Swelling on Air Permeability of Water-Swellable FFCS's

| | Air Permeability | |
|---|---|---|
| FFCS No. 3 (Cotton) | dry 80–90* | wet 25–35* |
| Cotton broad cloth | dry 760* | wet 440* |

*ltr/m²/sec

EXAMPLE 16

Influence of Vacuum Exposure Time

FFCS: No. 10
APSM: MEF
Formulation A
Blow Ratio: varied

| Blow Ratio | 150 | | | 60 | | | 25 | | |
|---|---|---|---|---|---|---|---|---|---|
| Vac Exp. | a | b | c | a | b | c | a | b | c |
| resid.wat. % owf | 118 | 102 | 84 | 80 | 73 | 65 | 80 | 67 | 63 |

a:b:c = 1:2:4 vacuum exp. time

EXAMPLE 17

(18a) Removal of Water Containing Agents
FFCS: No. 56
APSM: Cotton Broadcloth, not mercerised
Foam Blow Ratio: 60:1
Formulation A The fabric was padded in caustic solution of mercerising strength (266 g NaOH/liter), then it was dewatered with foam (sucked through the fabric, with FFCS No. 56 between vacuum and APSM) repeatedly. Foam volume 200 ml/dm², formulation A, blow ratio 65:1. No rinsing liquid was applied to the fabric between foam dewatering treatments. The foam temperature was 20° C.

Results

The water content of the highly swollen cotton fabric dropped from 104% owf to, 81.9% owf, the caustic content from 0.5288 g/dm², i.e. 52.88 g/m² (=100%) to 0.1040 g/dm², i e. 10.4 g/m² (=19.7% of the original value), which corresponds to a concentration of 52.3 g NaOH/liter. In plant practice, a lowering of the caustic concentration from 266 g NaOH/liter to 56 g NaOH/-lite by multiple cold and warm rinsing is considered satisfactory (at this concentration, a cotton fabric after mercerising may be released from width-retaining devices with risking substantial shrinkage). Five foam dewatering treatments (cold) have achieved better caustic removal.

17b

A mercerised cotton fabric (scoured, bleached broad cloth) was padded in caustic (266 g NaOH/liter), the add-on being 101% owf.

The fabric was then treated in different ways to remove as much caustic as possible with a minimum of rinsing water.

Sample 1 as dewatered one to five times with foam (formulation A, 300 ml/dm² each time, no intermediate adding of water, blow ratio 65:1. FFCS No. 56—same formulation, same weight of water).

All these treatments were carried out at room temperature.

Sample 2 was rinsed 5 times with 200 ml cold water/dm², i.e. more than 30 times the weight used in foamed form.

Sample 3 was treated as Sample 2, but with 200 ml/dm² of hot water (72° C.).

17c): (124c)

Same fabric, same caustic treatment as in Example 13b. Dewatering with foam under the same conditions as in Example 13b.

| | residual caustic (% of caustic present before dewat.) | residual water cont. owf | total volume of rinsing water used (liter/kg fabric) |
|---|---|---|---|
| (a) one foam dewaterg. treatments | 49.1% | 87.9% | 2.53 l/kg |
| (b) two foam dewatering treatm. | 29.0% | 78.5% | 5.30 l/kg |
| (c) three foam dewatering treatm. | 18.3% | 74.8% | 8.1 l/kg |
| (d) one treatment with | 49.0% | 97.0% | 2,94 l/kg |

-continued

| | residual caustic (% of caustic present before dewat.) | residual water cont. owf | total volume of rinsing water used (liter/kg fabric) |
|---|---|---|---|
| unfoamed water sucked through (same weight as in (a)) | | | |
| (e) three treatments with unfoamed water sucked through (same weight as in (c)) | 35.8% | 103% | 5.88 l/kg |
| Fabric before dewatering | 100% | 100% | — |

EXAMPLE 18

Dewatering of fiberstock (cotton, scoured and bleached, surgical cotton grade) (15)

FFCS: No. 10
Formulation A
Blow ratio: 60:1
Foam volume: 300 ml/dm$^2$

| | Residual Water Content (% owf) | |
|---|---|---|
| | one layer of cotton | two layers of cotton |
| plain water sucked through | 180% | 275% |
| Formulation A (not foamed) sucked through | 165% | 335% |
| Formulation A foamed sucked through | 135% | 135% |

EXAMPLE 19

Dewatering of Pile Fabric (125)

19a: Dewatering of wet terry towel fabric (cotton, 521 g/square meter, scoured, bleached and dyed).
Formulation A, foam blow ratio 60:1, 300 ml foam/dm$^2$
FFCS No. 10: residual water content 125%
FFCS No. 56: residual water content 117.5%
19b: Dewatering of wet corduroy (cotton, 347 g/sq.meter, scoured, bleached, dyed)
Formulation B, foam blow ratio 65:1, 300 ml foam/dm$^2$

| | Residual water content owf |
|---|---|
| Mangle | 65% |
| FFCS No. 56 | 58.5% |

EXAMPLE 20

Vacuum Data, Vacuum Effects

20a: Foam Permeation Time Through Different APSM's 600 ml of foam (formulation A, blow ratio 65:1) were sucked through to different ASPM's. Permeation time and 6 different FFCS foam permeation time was determined (sec).

| | FFCS | | | | | |
|---|---|---|---|---|---|---|
| APSM | No. 37 | No. 11 | No. 31 | No. 3 | No. 46 | No. 10 |
| Blott. Pap. | 22 | 32 | 35 | 48 | 65 | 95 |

-continued

| | FFCS | | | | | |
|---|---|---|---|---|---|---|
| APSM | No. 37 | No. 11 | No. 31 | No. 3 | No. 46 | No. 10 |
| Tissue | 23 | 24 | 23 | 29 | 28 | 108 |

EXAMPLE 21

Dewatering with Wire Screen Acting as Conveyor Belt

A nonwoven (MEF) containing about 220% of water was (a) dewatered with vacuum by vacuum travelling on a wire screen (. . . mesh) across a vacuum slot. To determine the influence of dewatering with foam (vs dewatering in a conventional way with vacuum) and the influence of the FFCS, the same trial was carried out (b) without foam and (c) with foam without an FFCS.

| | Water Content |
|---|---|
| MEF before dewatering | 250% |
| MEF vacuum treated without foam | 243% |
| MEF vacuum treated with* foam with FFCS | 218% |
| MEF vacuum treated with* foam on FFCS | 70% |

*Blow ratio 35:1

EXAMPLE 22

Lowering of Foaming Rate During Dewatering

APSM: Gauze
FFCS: 40–100 micron mesh aperture
22a:
Formulation A
Blow ratio 40:1 before permeation through system
Blow ratio 21:1 after permeation
Pot life of foam
before permeation: 60 minutes
after permeation: 25 minutes
Dewatering effect: 80% owf
22b:
Formulation C
Blow ratio 40:1 before permeation through system.
Blow ratio virtually zero after permeation (foam practically completely converted into water).
Dewatering effect: 73% owf
22c:
Formulation C
Blow ratio 65:1 before permeation,
Blow ratio practically nil after permeation
Dewatering effect 106%
22d: Same trial, but without APSM (foam sucked through FFCS only).

| Blow ratio before permeation through FFCS | Blow ratio after permeation |
|---|---|
| 86:1 | 77:1 |
| 66:1 | 58:1 |
| 46:1 | 56:1 |
| liquid | 27:1 |

EXAMPLE 23

A MEF nonwoven (air permeability 1200 $1/m^2/sec$) was dewatered by passing it in wet state (water content 180–220% owf) across two vacuum slots. The web was riding on a bronze wire mesh (air permeability 5'500 $1/m^2/sec$). Residual water content after the treatment was 65% to 70% owf within the batch of a dynamic test. These results show that even if properly selected, FFCS has an air permeability substantially higher than the APSM excellent results can be obtained.

EXAMPLE 24

Comparison between water and foam sucked through APSM (with and without FFCS) and unfoamed water containing surfactant present in APSM producing foam under the action of vacuum with and without FFCS—test series 130—).

Example 24

| Test No. | Water content before treatment | Treatment | FFCS present | Water content after treatment |
|---|---|---|---|---|
| 130.1a | 210% | 300 $ml/dm^2$ sucked through | no | 184% |
| 130.1b | 212% | as 130.1a | yes | 73.5% |
| 130.2a | 209% | 10 $ml/dm^2$ sucked through (unfoamed formul. A) | no | 220% |
| 130.2b | 210% | as 130.2a | yes | 120% |
| 130.3a | 196% | 10 $ml/dm^2$ pure water, sucked through | no | 220% |
| 130.3b | 205% | same as 130.3a | yes | 128% |
| 130.4a | 190% | just vacuum applied to wet web | no | 180% |
| 130.4b | 209% | same as 130.4a | yes | 129% |
| 130.5a | 210% | web dipped in formulation A, unfoamed vacuum applied | no | 212% |
| 130.5b | 208% | same as 130.5b | yes | 115% |
| — | 210% | strong mangle treatment | — | 118% |

Remarks (1) Tests "a" compared to tests "b" show influence of FFCS.

(2) Test 130.1b shows the superior effects of the treatment according to the invention over the other variations.

(3) Tests 130.1ab compared to tests 130.2a–130.3b show the superiority of foam over unfoamed formulations.

(4) Tests 130.4a/4b to 130.5a/5b shows that the process claimed in U.S. Pat. No. 4,062,721 (Geyer) does not produce results substantially different from those obtained with conventional vacuum extraction or removal of water by mangling.

I claim:

1. A process for dewatering an air permeable sheet material containing water, which process comprises:

applying to one side of an air permeable sheet material foam containing an agent capable of lowering the surface tension of the foam liquid;

causing the foam to permeate the interstices of the sheet material by application of a pressure gradient across the sheet material; and removing the foam material and water from the other side of the sheet material, whereby the foam liquid causes water in the air permeable sheet material to be substantially removed from the interstices of the sheet material.

2. A process as claimed in claim 1 wherein the pressure gradient is provided by mechanically forcing the foam therein.

3. A process as claimed in claim 1 wherein the pressure gradient is established by providing pressure to the side of the sheet material to which he foam is applied.

4. A process as claimed in claim 1 wherein the pressure gradient is established by the application of a vacuum to the side of the sheet material remote from that to which the foam is applied.

5. A process as claimed in claim 1 wherein the foam is in the form of an aqueous foam.

6. A process as claimed in claim 1 wherein the foam is in the form of a non-aqueous foam.

7. A process as claimed in claim 1 wherein the foam is in the form of an emulsion.

8. A process as claimed in claim 1 wherein the agent capable of lowering the surface tension is one which decomposes at a temperature within the range of 50° C. to 200° C. whereby the agent is removed during any subsequent drying or heat treatment.

9. A process as claimed in claim 1 wherein the size of the foam cells is fairly uniform.

10. A process as claimed in claim 1 wherein the maximum cell size of the foam is not more than $\frac{1}{4}$ the thickness of the air permeable sheet material to which it is applied.

11. A process as claimed in claim 1 wherein the foaming rate of the foam applied to the sheet material is within the range of 300:1 to 5:1.

12. A process as claimed in claim 11 wherein the volume of foam permeating the sheet material is such that the foaming rate of the foam removed from the air permeable sheet material after passage therethrough is 10 to 80% lower than the foaming rate of the foam originally applied.

13. A process as claimed in claim 1 wherein the operating conditions as regards foam stability, foam volume, foam rate, and foam pressure applied, are such that the foaming rate of the foam emerging from the air permeable sheet is less than 50% of the foaming rate of the foam applied to the air permeable sheet material.

14. A process as claimed in claim 1 wherein a foam flow constraining substrate is in juxtaposition with the air permeable sheet material to support the same during the foam treatment.

15. A process as claimed in claim 14 wherein the foam flow constraining substrate is juxtaposed the air permeable sheet material on the side remote from that to which the foam is applied.

16. A process as claimed in claim 14 wherein the foam flow constraining substrate is juxtaposed the air permeable sheet material on the side thereof to which the foam is applied.

17. A process as claimed in claim 14 wherein the foam flow constraining substrate is arranged to move with the air permeable sheet material.

18. A process as claimed in claim 14 wherein the foam flow constraining substrate is a sheet material having porous characteristics ensuring a substantially uniform permeation of air, liquid and foam through the interstices thereof, said substrate having an air permeability at least equal to the air permeable sheet material to be treated.

19. A process as claimed in claim 14 wherein the dimension of pores or interstices of the foam flow constraining substrate is not more than 50 microns.

20. A process as claimed in claim 14 wherein the foam flow constraining substrate is a woven fabric, a nonwoven web, or a mesh.

21. A process as claimed in claim 14 wherein the foam flow constraining substrate is a woven fabric having an air permeability of not more than 250 liters per square meter per second or a non-woven structure or mesh having an air permeability of not more than 2000 liters per square meter per second.

22. A process as claimed in claim 14 wherein said substrate is maintained in close contact with said sheet material throughout the treatment with the foam.

23. A process as claimed in claim 14 wherein the foam is caused to permeate the interstices of the sheet material by means of a pressure gradient, said pressure gradient being generated by means of a vacuum applied on the side of the air permeable sheet material remote from the side on which the foam is applied, said vacuum being applied by passing the air permeable material across at least one vacuum slot, each vacuum slot being defined by an open tube pipe or duct connected to a vacuum producing pump.

24. A process as claimed in claim 23 wherein these are multiple vacuum slots are arranged in a plane, a curve, or within a rotating drum.

25. A process as claimed in claim 24 wherein the substrate is caused to travel at an angle of not more than 60° to the horizontal plane when traversing said vacuum slot.

26. A process as claimed in claim 1 wherein the foam includes at least one agent for the removal of deleterious matter from said air permeable sheet material.

27. A process as claimed in claim 1 wherein the said air permeable sheet material is dry when the foam is first applied.

28. A process as claimed in claim 1 wherein the air permeable sheet material is wet when the foam is first applied.

29. A process as claimed in claim 26 wherein the foam additionally contains compounds capable of neutralizing, emulsifying, and/or dispersing delterious matter or agents present in said sheet material.

30. A process as claimed in claim 1 wherein a further application of foam containing an agent capable of lowering the surface tension is applied to the air permeable sheet material, said foam being caused to permeate the interstices of the sheet material and thereafter removing the foam and/or constituents of the foam from the sheet material.

31. A process as claimed in claim 1 wherein the foam liquid applied to the air permeable sheet material contains agents to be interacted with or deposited into said air permeable sheet material.

32. A process as claimed in claim 29 wherein the amount of water present in the air permeable sheet material is within the ±25% of the minimum foam transit water content of the air permeable sheet material when the foam is applied to it.

33. A process as claimed in claim 1 further comprising forming the foam containing the agent.

* * * * *